US007808462B2

(12) United States Patent
Tanase et al.

(10) Patent No.: US 7,808,462 B2
(45) Date of Patent: Oct. 5, 2010

(54) DISPLAY APPARATUS

(75) Inventors: Susumu Tanase, Kadoma (JP); Atsuhiro Yamashita, Osaka (JP); Masutaka Inoue, Hirakata (JP); Yukio Mori, Hirakata (JP)

(73) Assignee: Sanyo Electric Co., Ltd. (JP)

( * ) Notice: Subject to any disclaimer, the term of this patent is extended or adjusted under 35 U.S.C. 154(b) by 1214 days.

(21) Appl. No.: 11/385,707

(22) Filed: Mar. 22, 2006

(65) Prior Publication Data

US 2006/0214942 A1 Sep. 28, 2006

(30) Foreign Application Priority Data

Mar. 22, 2005 (JP) ..... JP2005-080999

(51) Int. Cl.
*G09G 3/32* (2006.01)
*G09G 3/36* (2006.01)
*G09G 5/02* (2006.01)

(52) U.S. Cl. ..... 345/83; 345/88; 345/600

(58) Field of Classification Search ..... 345/600, 345/602, 694, 88
See application file for complete search history.

(56) References Cited

U.S. PATENT DOCUMENTS 5,929,843 A * 7/1999 Tanioka ..... 345/600
6,954,191 B1 10/2005 Hirano et al.
7,483,011 B2 * 1/2009 Yang et al. ..... 345/88

FOREIGN PATENT DOCUMENTS

JP 5241551 9/1993
JP 11-295717 10/1999
JP 2002149116 5/2002

OTHER PUBLICATIONS

Japanese Office Action issued in a corresponding case, Jun. 9, 2009.

* cited by examiner

*Primary Examiner*—Kevin M Nguyen
(74) *Attorney, Agent, or Firm*—NDQ&M Watchstone LLP

(57) ABSTRACT

A display apparatus includes an RGB-RGBX signal converter having a variable RGB-RGBX conversion ratio and configured to convert an RGB signal into an RGBX signal. An RGBX type self light-emitting display is configured to display video, based on the RGBX signal obtained by the RGB-RGBX signal converter. A controller is configured to control the RGB-RGBX conversion ratio utilized for converting the RGB signal into the RGBX signal, in accordance with a display position of the RGB signal.

4 Claims, 14 Drawing Sheets

FIG.28

| | | | | | | | | | | | |
|---|---|---|---|---|---|---|---|---|---|---|---|
| 0 | 1 | 1 | 1 | 0 | 0 | 1 | 1 | 1 | 1 | 1 | 0 |
| 0 | 1 | 1 | 1 | 0 | 0 | 1 | 1 | 1 | 1 | 1 | 0 |
| 0 | 1 | 1 | 1 | 0 | 0 | 1 | 1 | 1 | 1 | 1 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

DISPLAY APPARATUS

CROSS REFERENCE TO RELATED APPLICATION

This application is based upon and claims the benefit of priority from prior Japanese Patent Application P2005-080999 filed on Mar. 22, 2005; the entire contents of which are incorporated by reference herein.

BACKGROUND OF THE INVENTION

1. Field of the Invention

The present invention relates to a display apparatus including a self light-emitting display, such as an organic electroluminescence (EL) display, an inorganic EL display, or a plasma display.

2. Description of the Related Art

Self light-emitting displays such as an organic EL display are characterized in the thin thickness, light weight, and low power consumption and the like and are used for an increasing number of applications. However, in applications for a cellular phone, a digital still camera or the like, these displays have been required to provide further lower power consumption.

A red (hereinafter referred to as a symbol "R"), a green (hereinafter referred to as a symbol "G"), and a blue (hereinafter referred to as a symbol "B") type organic EL display in which white (hereinafter referred to as a symbol "W") luminescence material is attached with color filters of RGB has been already developed. The RGB type organic EL display includes organic EL elements for the respective R, G, and B unit pixels. In the RGB type organic EL display, when light passes through a color filter, a part of the light is absorbed by the color filter thus deteriorating the light use efficiency. This low light use efficiency suppresses the power consumption from being decreased.

In view of the above, the present applicant has already developed a signal processor of an organic EL display. The signal processor is the one of an RGBW type organic EL display (self light-emitting display) in which one pixel is composed of four unit pixels of R, G, B, and W and the R, G, and B unit pixels include color filters and the W unit pixel does not include a color filter. The signal processor can reduce the power consumption. The RGBW type organic EL display includes organic EL elements for the respective R, G, B and W unit pixels.

With respect to the RGBW type self light-emitting display, burn-in occurs because of dispersion of pixel deterioration among R, G, B, and W unit pixels. Especially, when a fixed picture such as an icon is displayed, unit pixels having large luminance in the fixed picture are easy to become deterioration.

SUMMARY OF THE INVENTION

The present invention provides a display apparatus capable of reducing dispersion of pixel deterioration among RGBX (symbol "X" refers to an arbitrary color other than RGB) unit pixels, and of suppressing burn-in.

A first aspect of the present invention inheres in a display apparatus encompassing, a RGB-RGBX signal converter having a variable RGB-RGBX conversion ratio and configured to convert a RGB signal into a RGBX signal, X refers to an arbitrary color other than R, G, and B, a RGBX type self light-emitting display configured to display video, based on the RGBX signal obtained by the RGB-RGBX signal converter, and a controller configured to control the RGB-RGBX conversion ratio utilized for converting the RGB signal into the RGBX signal, in accordance with a display position of the RGB signal.

A second aspect of the present invention inheres in a display apparatus encompassing, a RGB-RGBX signal converter having a variable RGB-RGBX conversion ratio, and configured to convert a RGB signal into a RGBX signal, X refers to an arbitrary color other than R, G, and B, a RGBX type self light-emitting display configured to display video, based on the RGBX signal obtained by the RGB-RGBX signal converter, including a video display region which is an area between upper and lower parts of the self light-emitting display, and configured to display an input video, a no-video display regions which are areas of the upper and lower parts of the self light-emitting display, and configured to display gray bands when an aspect ratio of the input video is different from an aspect ratio of the self light-emitting display, a determination circuit configured to determine whether a display position of the RGB signal is in the video display region or in the no-video display regions, and a controller configured to control the RGB-RGBX conversion ratio utilized for converting the RGB signal into the RGBX signal, in accordance with a determination result of the determination circuit, wherein the controller sets a different value to the RGB-RGBX conversion ratios of a case where the display position is in the video display region and a case where the display position is in the no-video display regions.

A third aspect of the present invention inheres in a display apparatus encompassing, a RGB-RGBX signal converter having a variable RGB-RGBX conversion ratio, and configured to convert a RGB signal into a RGBX signal, X refers to an arbitrary color other than R, G, and B, a RGBX type self light-emitting display configured to display video, based on the RGBX signal obtained by the RGB-RGBX signal converter, a determination circuit configured to determine whether a display position of the RGB signal is in an icon display region displaying an icon or in no-icon display region not displaying the icon, and a controller configured to control the RGB-RGBX conversion ratio utilized for converting the RGB signal into the RGBX signal, in accordance with a determination result of the determination circuit, wherein the controller sets a different value to the RGB-RGBX conversion ratios of a case where the display position is in the icon display region and a case where the display position is in the no-icon display regions.

A fourth aspect of the present invention inheres in a display apparatus encompassing, a RGB-RGBX signal converter having a variable RGB-RGBX conversion ratio, and configured to convert a RGB signal into a RGBX signal, X refers to an arbitrary color other than R, G, and B, a RGBX type self light-emitting display configured to display video, based on the RGBX signal obtained by the RGB-RGBX signal converter, a total light emission amount memory configured to memorize a total light emission amount by calculating the total light emission amount of respective RGBX unit pixels constituting pixels for each pixel, a calculator configured to calculate a difference between a maximum value of the total light emission amount of the respective RGB pixels in pixels corresponding to a display position of the RGB signal and the total light emission amount of the X unit pixel in pixels corresponding to the display position, based on data memorized in the total light emission amount memory, and a controller configured to control the RGB-RGBX conversion ratio utilized for converting the RGB signal into the RGBX signal, based on the difference calculated by the calculator.

In the display apparatus according to the fourth aspect, the controller may set a value smaller than an initial setting value to the RGB-RGBX conversion ratio when the difference is greater than a first threshold, and set the initial setting value to the RGB-RGBX conversion ratio when the difference becomes smaller than a second threshold which is smaller than the first threshold.

BRIEF DESCRIPTION OF THE DRAWINGS

FIG. 28 is a schematic diagram showing an icon display position table.

DETAILED DESCRIPTION OF THE INVENTION

Figure 1:
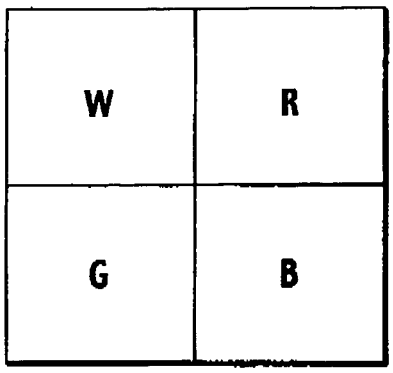
FIG. 1 is a schematic diagram showing an arrangement of a pixel including four units of RGBW.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

Comparative Example

The following section will describe a signal processor of the RGBW type self light-emitting display developed by the present applicant. The signal processor of the RGBW type self light-emitting display developed by the present applicant may be used for a self light-emitting display (e.g., organic EL display) in which white luminescence material is attached with a color filter. As shown in FIG. 1, the self light-emitting display is provided so that one pixel is composed of four unit pixels among which three unit pixels include color filters for displaying three primary colors (e.g., R, G, and B). The remaining one unit pixel does not include a color filter and is exclusively used for displaying W.

In the RGBW arrangement as described above, a unit pixel exclusively used for displaying white does not include a color filter and thus has a very high light use efficiency. Significant low power consumption can be realized when white 100% is displayed by causing the exclusive unit pixel for displaying white to emit light to display white 100% instead of causing the unit pixels for displaying R, G, and B to emit light to display white 100%, for instance.

However, in an actual case, white obtained by the white luminescence material has a chromaticity that is frequently different from a chromaticity of target white. Therefore, it is required to add the light emission of the RGB unit pixels to the exclusive unit pixel for displaying white.

Thus, a signal processing method developed by which, when white obtained by a white luminescence material has a chromaticity different from the chromaticity of target white, then RGB input signals are converted to RGBW signals that correspond to the input signals, that have the same luminance and chromaticity, and that can reduce the power consumption.

[1] Arrangement of Display Apparatus

Figure 2:
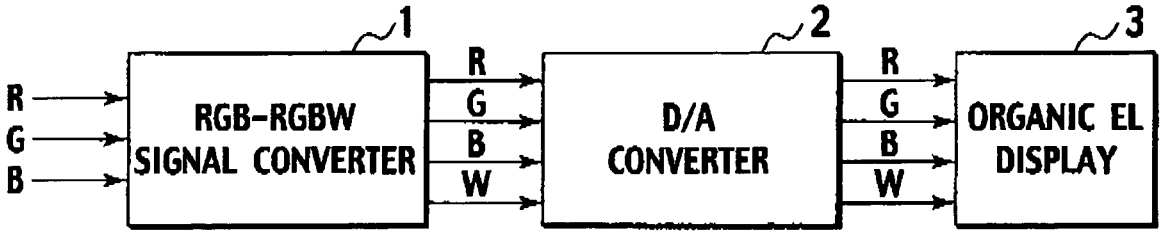
FIG. 2 is a block diagram showing an arrangement of a display apparatus.

FIG. 2 shows an arrangement of a display apparatus.

An RGB-RGBW signal converter 1 receives a digital RGB input signal. The RGB-RGBW signal converter 1 converts an RGB input signal to an RGBW signal. The RGBW signal obtained by the RGB-RGBW signal converter 1 is converted to an analog RGBW signal by a digital to analog (D/A) converter 2. The RGBW signal obtained by the D/A converter 2 is sent to an organic EL display 3 in which one pixel is composed of four RGBW unit pixels.

[2] Basic Concept of RGB-RGBW Signal Conversion

Figure 3:
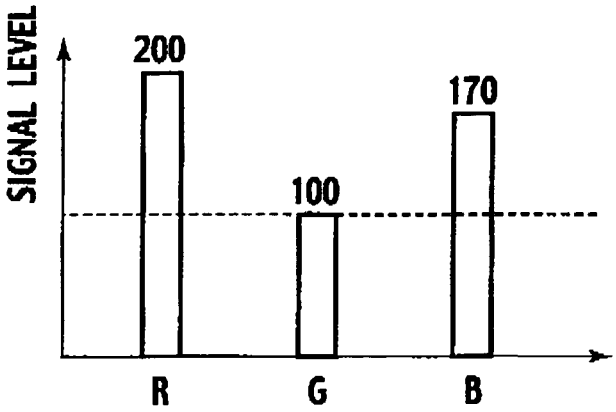
FIG. 3 is a schematic diagram showing an example of an RGB signal.

This exemplary embodiment assumes R, G, and B input signals as shown in FIG. 3. For convenience of description, the R, G, and B input signals are not previously subjected to gamma correction. It is also assumed that, such RGB luminance that realizes target white luminance and chromaticity based on only R, G, and B is previously set as a white-side reference luminance (white-side reference voltage to RGB of D/A converter 2). It is noted that the white-side reference luminance of W is adjusted so that a target luminance (W luminance determined by step S4 of FIG. 9) (which will be described later)) is reached when only W is displayed.

Figure 4:
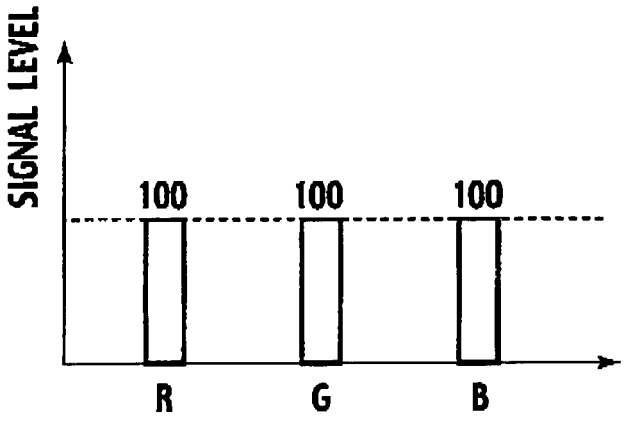
FIG. 4 is a schematic diagram showing a min(RGB).
Figure 5:
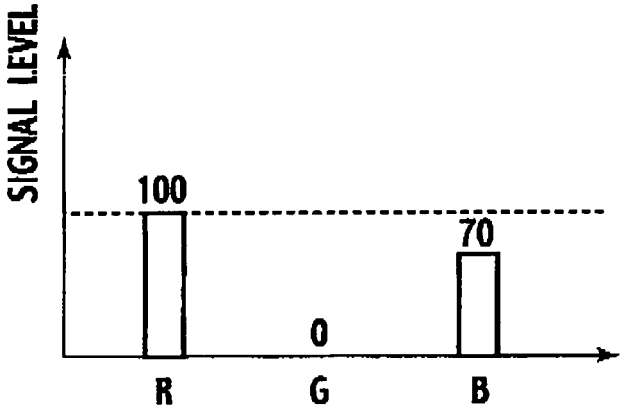
FIG. 5 is a schematic diagram showing "input signal−min (RGB)".

In this example, the RGB input signal value is represented by eight bits and R=200, G=100, and B=170. The minimum value of the RGB input signal value is 100. The RGB input signal value is separated, as shown in FIG. 4, to the minimum values (min(RGB)) and the other values (input signal−min (RGB)) as shown in FIG. 5. In the case of FIG. 4, when all of the RGB input signal values are 100, they are equivalent to a target white $W_t$ (100).

Figure 6:
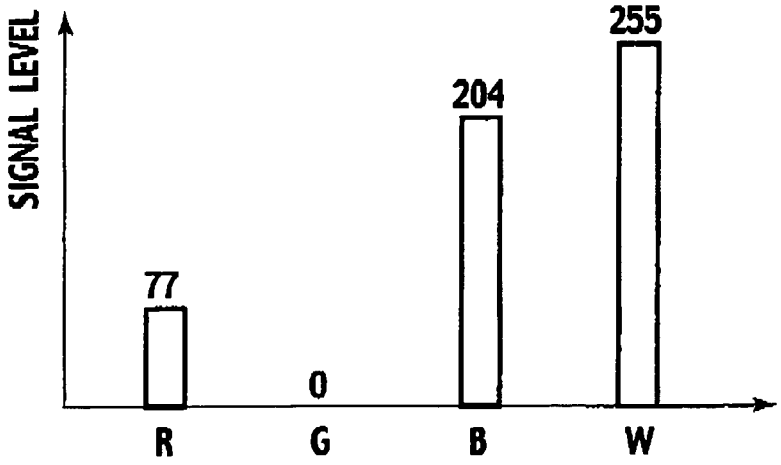
FIG. 6 is a schematic diagram showing an RGBW signal ratio for representing $W_t$ (255).
Figure 7:
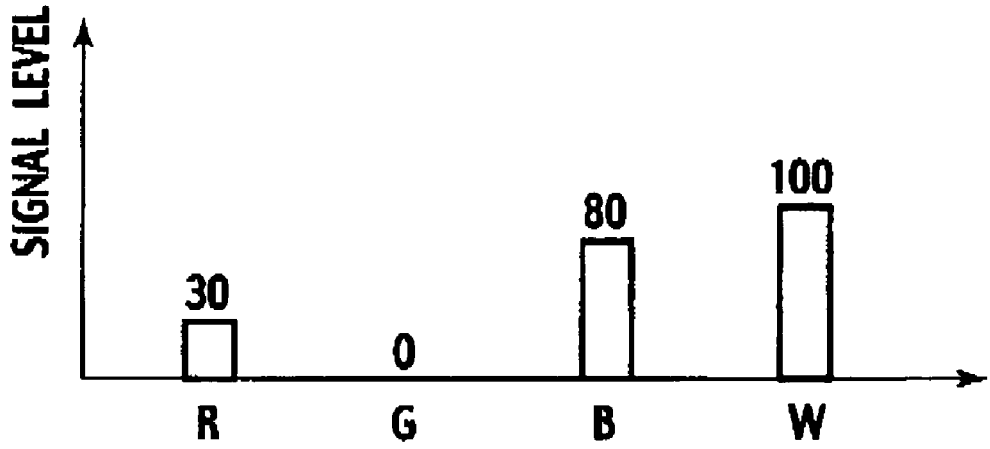
FIG. 7 is a schematic diagram showing an RGBW signal ratio for representing $W_t$ (100).

For example, when assuming that the R, G, B, and W signal values are signal values as shown in FIG. 6 (77, 0, 204, and 255) in order to express target white $W_1$ (255) when the R, G, and B input signal values are all 255, the R, G, B, and W input signal values in order to realize target white $W_t$ (100) when the R, G, and B input signal values are all 100 are as shown in FIG. 7.

The signal values as shown in FIG. 6 can be calculated based on R, G, and B luminance values and R, G, B, and W luminance values in order to realize the target white. It is assumed that R, G, B, and W signal values in order to realize target white when the R, G, and B input signal values are all 255 are R1, G1, B1, and W1. When assuming that R, G, and B luminance values in order to realize target white luminance and chromaticity are LR1, LG1, and LB1 and RGB, and W luminance values in order to realize target white luminance and chromaticity are LR2, LG2, LB2, and LW2, then RGB, and W signal values in order to realize the target white when R, G, and B input signal values are all 255 are: R1=255×LR2/LR1, G1=255×LG2/LG1, B1=255×LB2/LB1, and $W_1$=255. In particular, W can be defined only by an RGBW display system and thus the unique results of 255 are obtained. A method for calculating RGB luminance value and RGBW luminance value in order to realize target white luminance and chromaticity will be described later.

The values of R, G, B, and W in FIG. 7 are calculated by the following formula (1).

$$R=77\times100/255=30$$

$$G=0\times100/255=0$$

$$B=204\times100/255=80$$

$$W=255\times100/255=100 \tag{1}$$

Here, the R, G, and B values of FIG. 4 are substituted with the R, G, and B values of FIG. 7. The R, G, and B values shown in FIG. 3 are converted into the R, G, and B values shown in FIG. 8 by adding the R, G, and B values of FIG. 5 to the R, G, and B values of FIG. 7.

Figure 8:
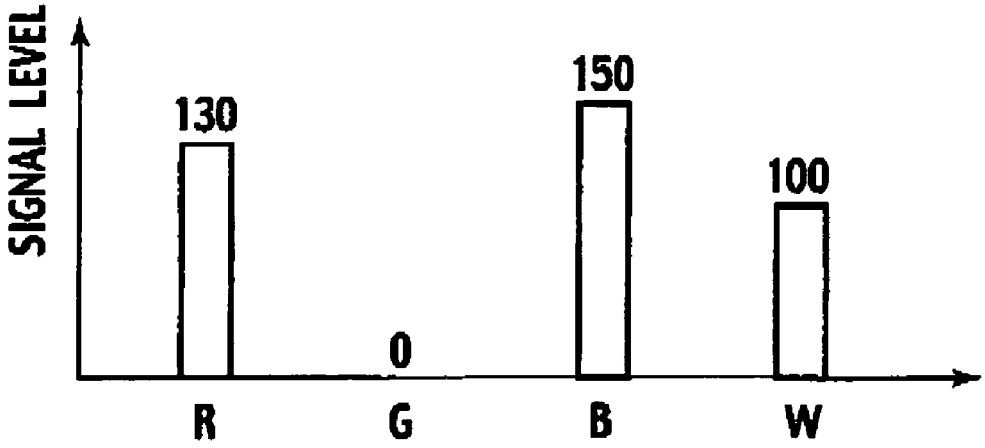
FIG. 8 is a schematic diagram showing an RGBW value calculated by adding the RGB value of FIG. 5 and the RGB value of FIG. 7.

The values of R, G, B, and W of FIG. 8 are calculated by the following formula (2).

$$R=100+30=130$$

$$G=0+0=0$$

$$B=70+80=150$$

$$W=0+100=100 \tag{2}$$

The white-side reference luminances of R, G, and B (R, G, and B luminance values in order to realize luminance and chromaticity of target white), RGBW luminance value in order to realize the luminance and chromaticity of the target white, and RGBW signal value in order to realize the target white when R, G, and B input signal values are all 255 are previously calculated by a panel adjustment processing.

[3] First RGB-RGBW Signal Conversion Processing

Figure 9:
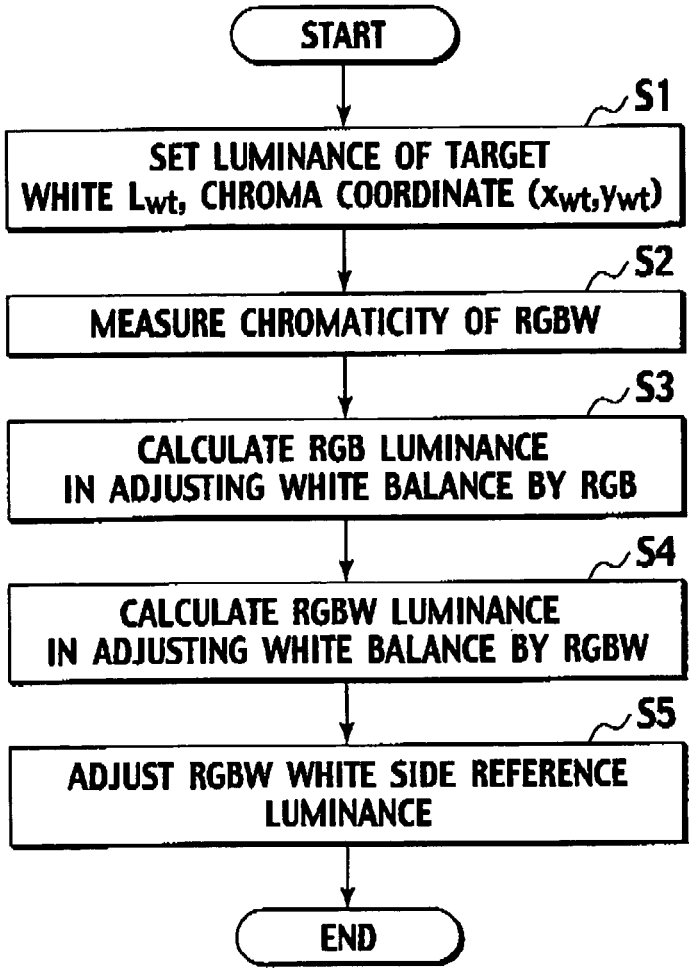
FIG. 9 is a flow chart showing a panel controlling procedure.

FIG. 9 shows a procedure of the panel adjustment processing.

First, a luminance $L_{wt}$ and chromaticity coordinates ($x_{wt}$, $y_{wt}$) of a target white $W_t$ are set (step S1).

Next, the RGBW chromaticity of the organic EL display 3 is measured (step S2). When the R chromaticity is measured for example, only unit pixels for displaying R of the organic EL display 3 are caused to emit light and the chromaticity is measured by an optical measurement device. Chromaticity coordinates of the measured RGBW are assumed as ($x_R$, $y_R$), ($x_G$, $y_G$), ($x_B$, $y_B$), and ($x_W$, $y_W$), respectively.

Next, R, G, and B luminance values when adjusting white balance (WB) by R, G, and B are calculated (step S3). Specifically, this step calculates, based on the three colors of R, G, and B, a luminance value $L_R$ (which corresponds to the above LR1), a luminance value $L_G$ (which corresponds to the above LG1), and a luminance value $L_B$ (which corresponds to the above LB1) of the R, G, and B in order to express the luminance $L_{wt}$ and the chromaticity ($x_{wt}$, $y_{wt}$) of the target white $W_t$. The luminance values $L_R$, $L_G$, and $L_B$ are calculated based on the following formula (3).

$$\begin{pmatrix} \frac{x_R}{y_R} & \frac{x_G}{y_G} & \frac{x_B}{y_B} \\ 1.0 & 1.0 & 1.0 \\ \frac{z_R}{y_R} & \frac{z_G}{y_G} & \frac{z_B}{y_B} \end{pmatrix} \begin{pmatrix} L_R \\ L_G \\ L_B \end{pmatrix} = \begin{pmatrix} \frac{x_{wt}}{y_{wt}} L_{wt} \\ L_{wt} \\ \frac{z_{wt}}{y_{wt}} L_{wt} \end{pmatrix} \tag{3}$$

In the formula (3), $z_R=1-x_R-y_R$, $z_G=1-x_G-y_G$, $z_B=1-x_B-y_B$, and $z_{wt}=1-x_{wt}$, $y_{wt}$.

Next, the R, G, B, and W luminance values for the adjustment of white balance (WB) by RGBW are calculated (step S4). Specifically, based on the four colors of RGBW, this step calculates luminance values $L_R$ (which corresponds to the above LR2), $L_G$ (which corresponds to the above LG2), $L_B$ (which corresponds to the above LB2), and $L_W$ (which corresponds to the above LW2) of RGBW in order to express the luminance $L_{wt}$ and the chromaticity ($x_{wt}$, $y_{wt}$) of the target white $W_t$.

Figure 10:
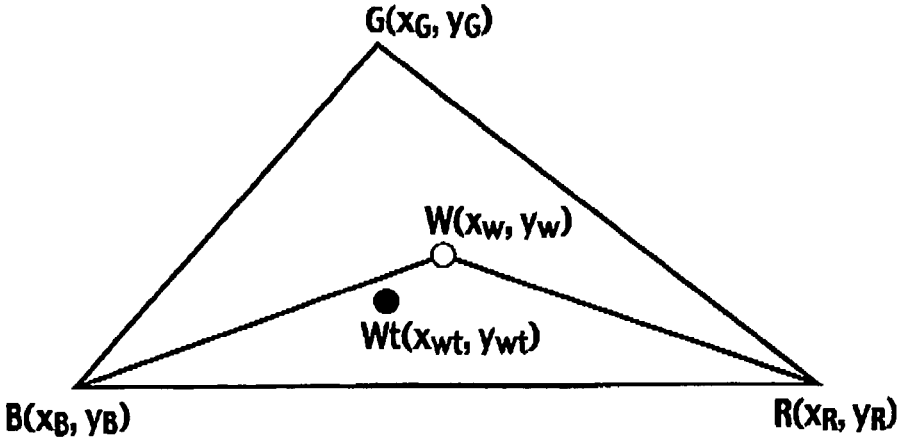
FIG. 10 is a schematic diagram showing chromaticity coordinates $(x_R, y_R)$, $(x_G, y_G)$, $(x_B, y_B)$, and $(x_W, y_W)$ of RGBW and chromaticity coordinates $(x_{wt}, y_{wt})$ of target white $W_t$.

When assuming that a relation between the RGB, and W chromaticity coordinates ($x_R$, $y_R$), ($x_G$, $y_G$), ($x_B$, $y_B$), and ($x_W$, $y_W$) and the target white $W_t$ chromaticity coordinate ($x_{wt}$, $y_{wt}$) is the one as shown in FIG. 10, the chromaticity of the target white $W_t$ can be represented by only the three colors of R, B, and W. Based on the three colors of R, B, and W, the R, B, W luminance values $L_R$ (which corresponds to the above LR2), $L_B$ (which corresponds to the above LB2), and $L_W$ (which corresponds to the above LW2) in order to express the luminance $L_{wt}$ and chromaticity ($x_{wt}$, $y_{wt}$) of the target white $W_t$ are calculated based on the following formula (4). In this case, $L_G$ corresponding to the above LG2 is zero.

$$\begin{pmatrix} \frac{x_R}{y_R} & \frac{x_w}{y_w} & \frac{x_B}{y_B} \\ 1.0 & 1.0 & 1.0 \\ \frac{z_R}{y_R} & \frac{z_w}{y_w} & \frac{z_B}{y_B} \end{pmatrix} \begin{pmatrix} L_R \\ L_w \\ L_B \end{pmatrix} = \begin{pmatrix} \frac{x_{wt}}{y_{wt}} L_{wt} \\ L_{wt} \\ \frac{z_{wt}}{y_{wt}} L_{wt} \end{pmatrix} \quad (4)$$

In the formula (4), $z_R=1-x_R-y_R$, $z_W=1-x_W-y_W$, $z_B=1-x_B-y_B$, and $z_{wt}=1-x_{wt}-y_{wt}$.

Next, the calculation result of the above step S3 is used to calculate RGBW white-side reference luminance (step S5).

When the RGB input signal value is represented by eight bits, the RGB white-side reference luminance is adjusted so that, when an RGB signal of (255, 255, 255) is supplied, the emission luminance and the emission color are the luminance $L_{wt}$ and the chromaticity ($x_{wt}$, $y_{wt}$) of the target white $W_t$. Specifically, when the RGB signal of (255, 255, 255) is supplied, the RGB white-side reference luminance is adjusted so that the R, G, and B luminances are the luminance value $L_R$, $L_G$, and $L_B$ calculated by the above step S3, respectively. When the RGB white-side reference luminance is adjusted as described above and when the input R, G, and B signals have an identical value, the emitted color always has the chromaticity of the target white. It is noted that the W white-side reference luminance is adjusted so that the W white-side reference luminance is the target luminance (W luminance value $L_W$ determined by step S4 of FIG. 9) when only W is displayed.

It is noted that the RGBW signal value in order to realize the target white $W_t$ (255) when the R, G, and B input signal values are all 255 is previously calculated based on the luminance value $L_R$ (which corresponds to the above LR1), the $L_G$ (which corresponds to the above LG1), the $L_B$ (which corresponds to the above LB1), the luminance value $L_R$ calculated by the above step S4 (which corresponds to the above LR2), the $L_G$ (which corresponds to the above LW2), the $L_B$ (which corresponds to the above LB2), and the $L_W$ (which corresponds to the above LW2) that are calculated by sep S3 of the panel adjustment processing.

Figure 11:
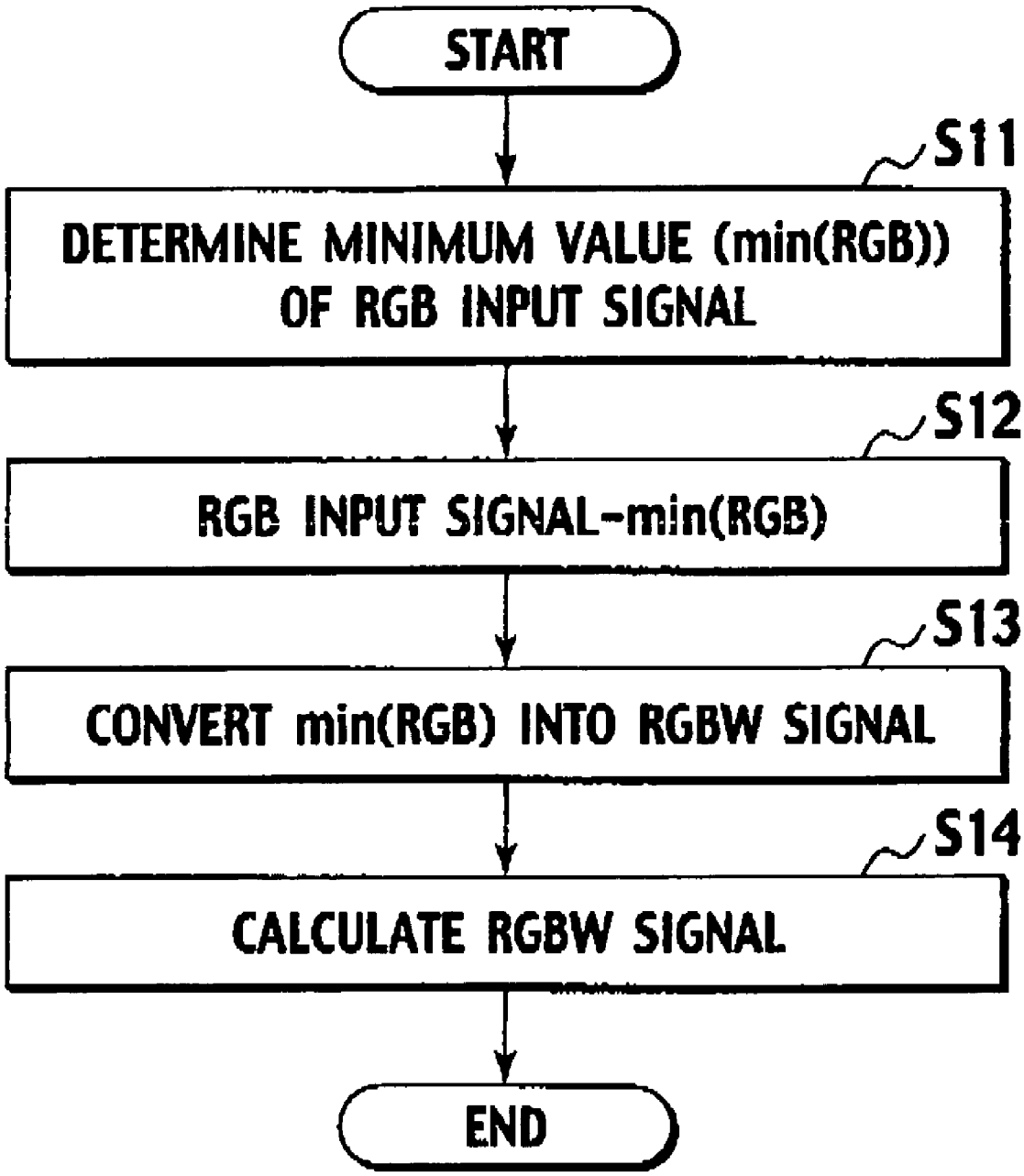
FIG. 11 is a flow chart showing a signal conversion procedure for converting an RGB signal into an RGBW signal.

FIG. 11 shows a procedure of a signal conversion processing for converting an RGB input signal to an RGBW signal.

First, the minimum value (min(RGB)) of an RGB input signal is determined (step S11). The example of FIG. 3 shows the min(RGB)=100.

Next, the min(RGB) is deducted from the respective R, G, and B input signals (step S12). The example of FIG. 3 shows the deduction results for R, G, and B are 100, 0, and 70 as shown in FIG. 5, respectively.

Next, by using the RGBW signal value in order to represent the target white $W_t$ (255) when the R, G, and B input signal values are all 255, the min(RGB) is converted to an RGBW signal (step S13). When assuming that an RGBW signal value in order to represent the target white $W_t$ (255) is a signal value as shown in FIG. 6, the RGBW signal corresponding to the min(RGB) in the example of FIG. 3 is a signal value as shown in FIG. 7.

Next, an RGBW signal corresponding to the RGB input signal is calculated by adding the deduction value calculated by the above step S12 {RGB−min(RGB)} with the signal value of the RGBW signal calculated by the above step S13 (step S14). In the example of FIG. 3, an RGBW signal corresponding to the RGB input signal is as shown in FIG. 8.

[4] Second RGB-RGBW Signal Conversion Processing

When the chromaticity of the target white can be represented by only the three colors of R, B, and W and when the minimum value of the RGB input signal is a G signal, then the processings of step S11 to step S14 of FIG. 11 (RGB-RGBW conversion routine) are used to obtain an RGBW signal in which one signal of R, G, and B signals (G signal) is zero.

When the chromaticity of the target white can be represented by only the three colors of R, B, and W and when the minimum value of the RGB input signal is a B signal, the processings of step S11 to step S14 of FIG. 11 (RGB-RGBW conversion routine) are also used to obtain an RGBW signal in which one signal of R, G, and B signals (B signal) is zero. When the chromaticity of the target white can be represented by only the three colors of G, B, and W and when the minimum value of the RGB input signal is an R signal, the processings of step S11 to step S14 of FIG. 11 (RGB-RGBW conversion routine) are also used to obtain an RGBW signal in which one signal of R, G, and B signals (R signal) is zero.

However, when the chromaticity of the target white can be represented by only the three colors of R, B, and W and when the minimum value of the RGB input signal is a color signal other than the G signal or when the chromaticity of the target white can be represented by only the three colors of R, B, and W and when the minimum value of the RGB input signal is a color signal other than the B signal, or when the chromaticity of the target white can be represented by only the three colors of G, B, and W and when the minimum value of the RGB input signal is a color signal other than the R signal, one execution of the processings of step S11 to step S14 of FIG. 11 (RGB-RGBW conversion routine) does not allow one signal in an RGB signal in an obtained RGBW signal to be not zero.

Specifically, some conditions prevent, when the RGB-RGBW conversion routine is performed only one time, one signal in an RGB signal in an obtained RGBW signal from being zero.

When an RGB input signal is converted to an RGBW signal so that one signal in the RGB signal in the RGBW signal is zero, a W signal has a larger value to increase the emission efficiency, thus providing lower power consumption.

Thus, the second RGB-RGBW signal conversion processing suggests a signal conversion method by which, regardless of conditions, an RGBW signal can be obtained in which one signal in an RGB signal is zero.

Figure 12:
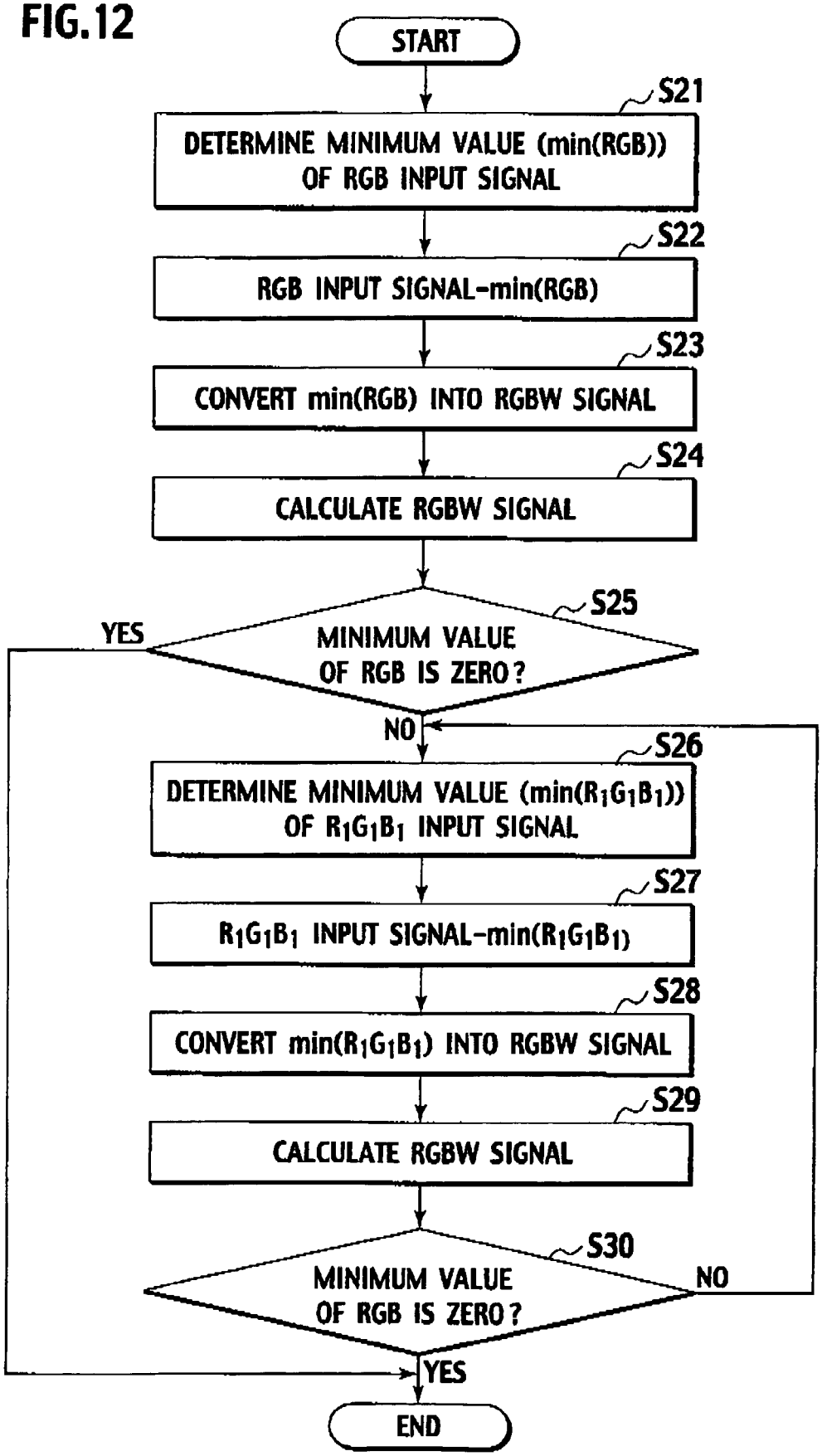
FIG. 12 is a flow chart showing another example of signal conversion procedure for converting an RGB signal into an RGBW signal.

FIG. 12 shows a procedure of the second RGB-RGBW signal conversion processing for converting an RGB input signal to an RGBW signal.

It is assumed that an RGBW signal value in order to represent a target white $W_t$ (255) when R, G, and B input signal values are all 255 is a signal value as shown in FIG. 6.

Figure 13:
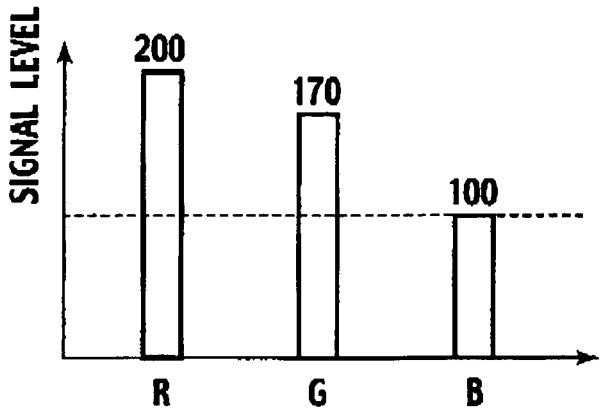
FIG. 13 is a schematic diagram showing an example of an RGB signals.
Figure 14:
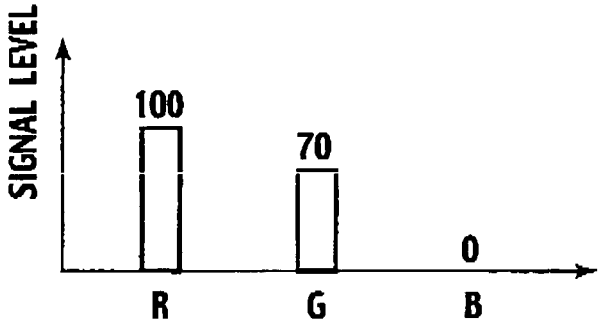
FIG. 14 is a schematic diagram showing "RGB signal−min (RGB)".

First, the minimum value (min(RGB)) in an RGB input signal is determined (step S21). When an RGB input signal value is R=200, G=170, and B=100 as shown in FIG. 13, then the min(RGB)=100 is established.

Figure 15:
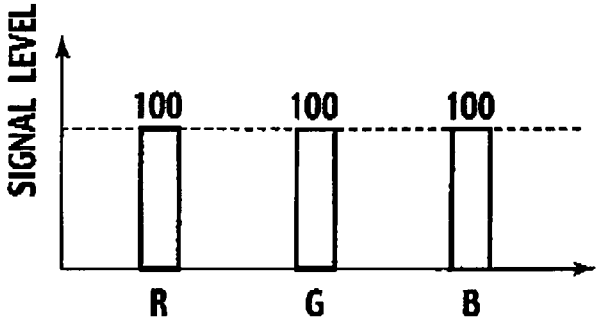
FIG. 15 is a schematic diagram showing a min(RGB).

Next, the min(RGB) is deducted from the respective R, G, and B input signals (step S22). In the example of FIG. 13, the deduction results for R, G, and B are, as shown in FIG. 14, 100, 70, and 0, respectively. Specifically, the RGB input signal is separated to the RGB signal value of FIG. 14 and the RGB signal value of FIG. 15.

Figure 16:
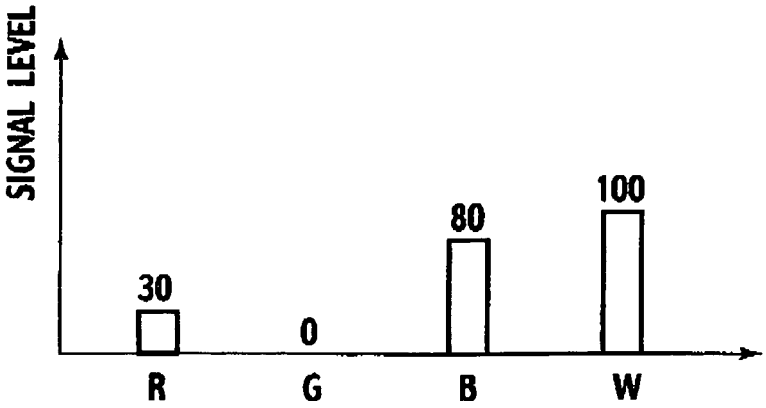
FIG. 16 is a schematic diagram showing an RGBW signal corresponding to min(RGB).

Next, the min(RGB) is converted to an RGBW signal using an RGBW signal value in order to represent target white $W_t$ (255) when R, G, and B input signal values are all 255 (step S23). When assuming that an RGBW signal value for realizing the target white $W_t$ (255) is a signal value as shown in FIG. 6, an RGBW signal corresponding to the min(RGB) in the example of FIG. 13 is the one as shown in FIG. 16 (which is identical with FIG. 7).

Next, by adding the deduction value {RGB−min(RGB)} calculated by the above step S22 to the signal value of the RGBW signal calculated by the above step S23, an RGBW signal corresponding to the RGB input signal is calculated (step S24). In the example of FIG. 13, an RGBW signal corresponding to the RGB input signal is as shown in FIG. 17.

Figure 17:
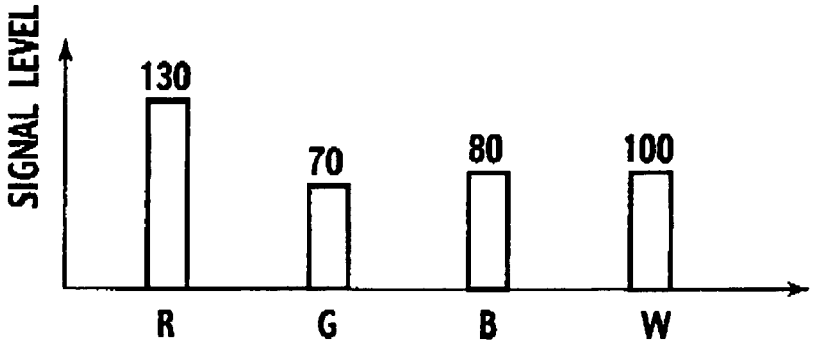
FIG. 17 is a schematic diagram showing an RGBW value calculated by adding the RGB value of FIG. 14 and the RGBW value of FIG. 16.

In FIG. 17, the values of RGB, and W are calculated by the following formula (5).

$$R=100+30=130$$

$$G=70+0=70$$

$$B=0+80=80$$

$$W=0+100=100 \quad (5)$$

Next, whether the minimum value of the RGB signal in the obtained RGBW signal is zero or not is determined (step S25). When the minimum value of the RGB signal in the obtained RGBW signal is zero, then the signal conversion processing is completed. Specifically, the RGBW signal obtained by the above step S24 is an RGBW output signal.

When the minimum value of the RGB signal in the obtained RGBW signal is not zero, then the obtained RGBW signal is recognized as an input RGBW signal and the same processings as those performed by the above steps S21 to S24 (RGB-RGBW conversion routine) are performed again.

Figure 18:
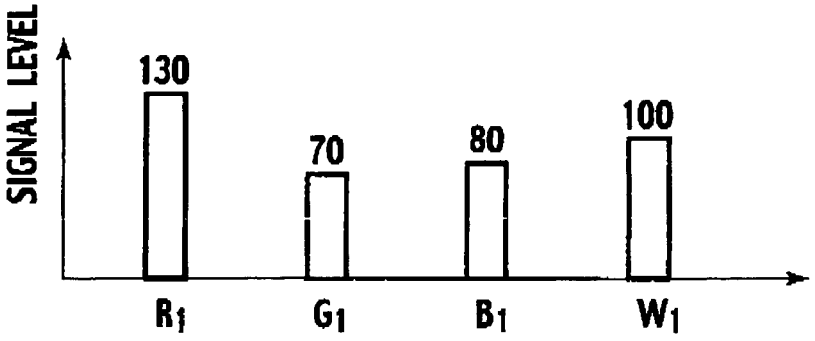
FIG. 18 is a schematic diagram showing an $R_1G_1B_1W_1$ input signal obtained from RGBW signal.
Figure 19:
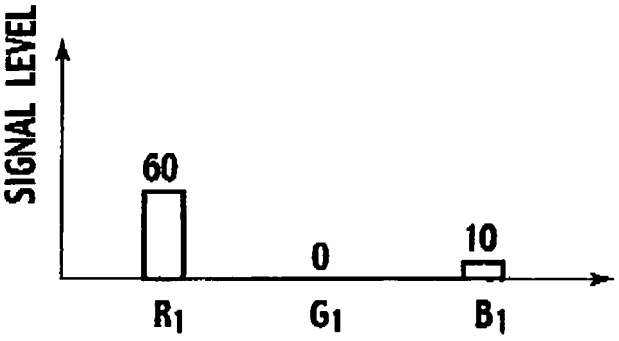
FIG. 19 is a schematic diagram showing an $R_1G_1B_1$ input signal−min($R_1G_1B_1$).
Figure 20:
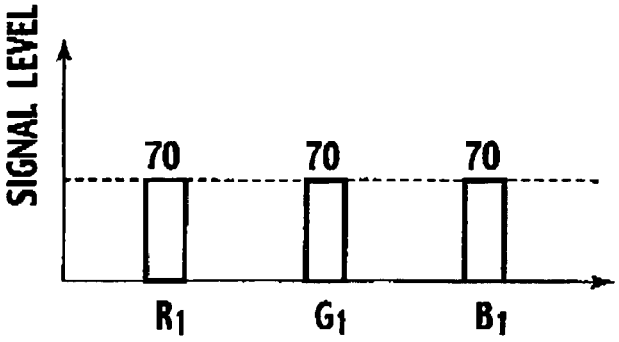
FIG. 20 is a schematic diagram showing a min($R_1G_1B_1$).

Specifically, when the minimum value of the RGB signal in the obtained RGBW signal is not zero, then the obtained RGBW signal is assumed as an $R_1G_1B_1W_1$ input signal as shown in FIG. 18. Then, the minimum value in the $R_1G_1B_1W_1$ input signal ($\min(R_1G_1B_1)$) is determined (step S26). In the case where the $R_1G_1B_1W_1$ input signal is R=130, G=70, B=80, and W=100 as shown in FIG. 18, then the $\min(R_1G_1B_1)=70$ is established as shown in FIG. 20.

Next, the $\min(R_1G_1B_1)$ is deducted from the respective $R_1$, $G_1$, and $B_1$ input signals (step S27). In the example of FIG. 18, the deduction results to R, G, and B are, as shown in FIG. 19, 60, 0, and 10, respectively. Specifically, the $R_1$, $G_1$, and $B_1$ input signals are separated to $R_1$, $G_1$, and $B_1$ signal values of FIG. 19 and $R_1$, $G_1$, and $B_1$ signal values of FIG. 20.

Next, the $\min(R_1G_1B_1)$ is converted to an RGBW signal using an RGBW signal value for representing the target white $W_t$(255) for which R, G, and B input signal values are all 255 (step S28). When the RGBW signal value for realizing the target white $W_t$(255) is a signal value as shown in FIG. 6, then the RGBW signal corresponding to the $\min(R_1G_1B_1)$ in the example of FIG. 20 has a signal value as shown in FIG. 21.

Figure 21:
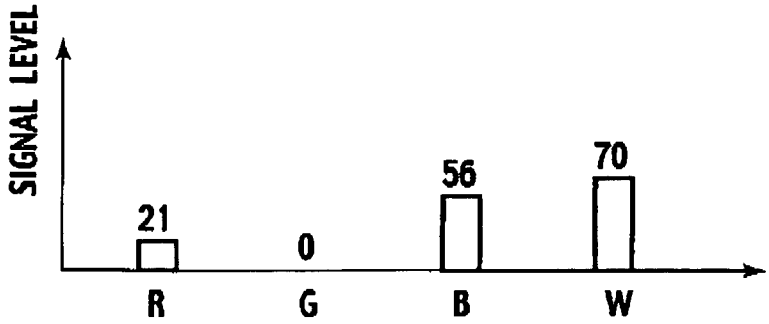
FIG. 21 is a schematic diagram showing an RGBW signal corresponding to a min($R_1G_1B_1$).

The RGB, and W values of FIG. 21 are calculated by the following formula (6).

$$R=77\times70/255=21$$

$$G=0\times70/255=0$$

$$B=204\times70/255=56$$

$$W=255\times70/255=70 \quad (6)$$

Next, by adding, to the deduction value $\{R_1G_1B_1-\min(R_1G_1B_1)\}$ calculated by the above step S27, the RGB signal value in the RGBW signal calculated by the above step S28 and by adding, to the $W_1$ in the $R_1G_1B_1W_1$ input signal, the W signal value in the RGBW signal calculated by the above step S28, a W signal is calculated (step S29). This provides the RGBW signal.

Figure 22:
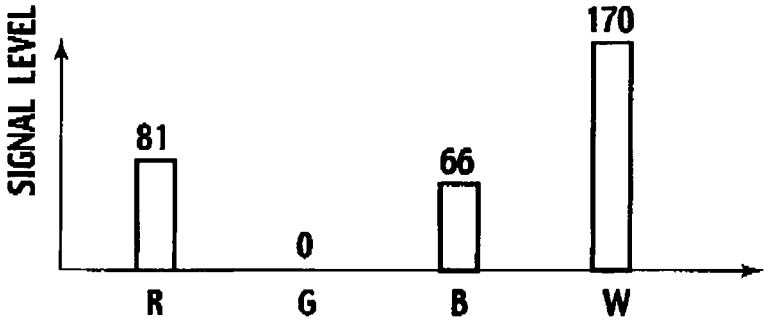
FIG. 22 is a schematic diagram showing an RGBW value calculated by adding the $R_1G_1B_1$ value of FIG. 19 and the $R_1G_1B_1W_1$ value of FIG. 21.

The above example shows the RGBW signal as shown in FIG. 22. The RGB, and W values of FIG. 22 are calculated by the following formula (7).

$$R=60+21=81$$

$$G=0+0=0$$

$$B=10+56=66$$

$$W=100+70=170 \quad (7)$$

Next, whether the minimum value of the RGB signal in the RGBW signal calculated by the above step S29 is zero or not is determined (step S30). When the minimum value of the RGB signal in the resultant RGBW signal is zero, then the signal conversion processing is converted.

When the minimum value of the RGB signal in the resultant RGBW signal is not zero, then the processing returns to the above step S26. Specifically, an RGB-RGBW conversion routine is repeatedly performed until the minimum value of the RGB signal in the resultant RGBW signal is zero.

[5] Third RGB-RGBW Signal Conversion Processing

As described in the above first RGB-RGBW signal conversion processing, some conditions may cause a signal having zero by deducting the min(RGB) to have a value equal to or higher than one by the subsequent conversion from the min(RGB) to an RGBW signal. In such a case, the RGB-RGBW conversion routine is repeatedly performed as described in the above second RGB-RGBW signal conversion processing.

The third RGB-RGBW signal conversion processing suggests a signal conversion method by which one RGB-RGBW conversion routine is performed to provide an RGBW signal in which at least one of R, G, and B signals is zero.

This exemplary embodiment focuses attention on one signal of R, G, and B signals and will describe the signal conversion process. When assuming that the signal for which attention is being paid is always handled as the min(RGB) and the conversion of the min(RGB) to an RGBW signal allows about 80% of the converted W signal to be fed back to the signal, then the signal for which attention is being paid changes, as shown in the following formula (8), depending on the number at which the RGB-RGBW conversion routine is performed when an initial value is 50 for instance.

$$50\rightarrow40\rightarrow32\rightarrow25.6\rightarrow20.5\rightarrow16.4\rightarrow13.1\ldots\rightarrow0 \quad (8)$$

In this case, the W signal has a value obtained by adding all values in the above formula (8) and can be calculated as the sum of an infinite geometric progression having a first term of 50 and a common ratio of 0.8. When −1<common ratio<1 is established, then the sum of the infinite geometric progression can be simplified to be the following formula (9).

$$\text{Sum of infinite geometric progression}=\text{first term}/(1-\text{common ratio}) \quad (9)$$

Thus, when the infinite geometric progression is represented by the above formula (8), the sum of the infinite geometric progression will be: 50/(1−0.8)=250.

In an actual system, the sum of the infinite geometric progression as described above is calculated for the respective R, G, and B signals to perform one RGB-RGBW conversion routine while assuming that the minimum one of them is the min(RGB). As a result, one of R, G, and B signals of the resultant RGBW signal is 0(zero) and the other two have values equal to or higher than zero.

The following section will describe an example in which R, G, and B input signal values are R=255, G=255, and B=50.

When assuming that the RGBW signal for representing the target white $W_L$ (255) in the case where R, G, and B input signal values are all 255 has signal values as shown in FIG. 6, then a feedback ratio of an RGB signal by the conversion of the min(RGB) to the RGBW signal is 0.3(=R of FIG. 6/W=77/255 of FIG. 6), 0 (=G of FIG. 6/W of FIG. 6), and 0.8 (=B of FIG. 6/W=204/255 of FIG. 6).

When assuming that the sum of the infinite geometric progression corresponding to R, G, and B is ΣR, ΣG, and ΣB, then ΣR, ΣG, and ΣB are as shown in the following formula (10).

$$\Sigma R=255/(1-0.3)=364$$

$$\Sigma G=255/(1-0)=255$$

$$\Sigma B=50/(1-0.8)=250 \quad (10)$$

Since the minimum value is 250, deduction of 250 from the RGB input signal value provides a deduction result as shown in the following formula (1).

$$R=255-250=5$$

$$G=255-250=5$$

$$B=50-250=-200 \quad (11)$$

When the min(RGB)(=250) is converted to an RGBW signal on the other hand, the conversion result is as shown in the following formula (12).

$$R=250\times 0.3=75$$

$$G=250\times 0=0$$

$$B=250\times 0.8=200$$

$$W=250 \quad (12)$$

Thus, the RGBW output signal is as shown in the following formula (13).

$$R=5+75=80$$

$$G=5+0=5$$

$$B=-200+200=0$$

$$W=250 \quad (13)$$

Figure 23:
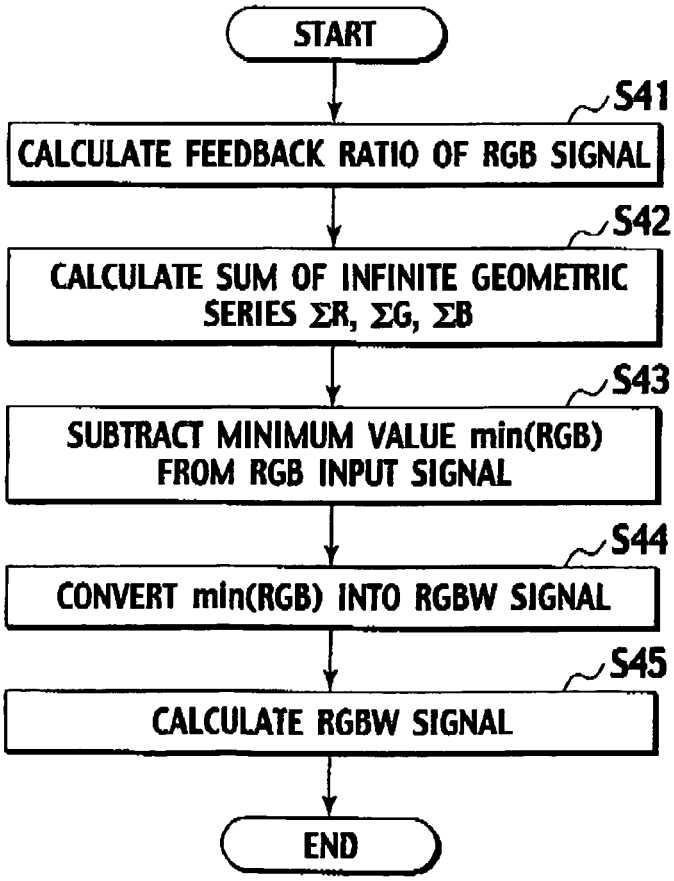
FIG. 23 is a flow chart showing still another example of a signal conversion procedure for converting an RGB signal into an RGBW signal.

FIG. 23 shows a procedure of the third RGB-RGBW signal conversion processing for converting an RGB input signal to an RGBW signal.

A feedback ratio of an RGB signal is calculated by an RGBW signal value for representing a target white $W_t$ (255) when R, G, and B input signal values are all 255 (step S41). When assuming that the RGBW signal value for representing the target white $W_t$ (255) has a signal value as shown in FIG. 6, then the feedback ratio of the RGB signal is 0.3(=77/255), 0, and 0.8(=204/255).

Next, with regards to the respective R, G, and B input signals, the sum of the infinite geometric progression of ΣR, ΣG, and ΣB is calculated in which the R, G, and B input signals are in the first term and the feedback ratio calculated by the above step S41 is the common ratio (step S42).

Next the minimum value of the sum of the infinite geometric progression of ΣR, ΣG, and ΣB calculated for the respective R, G, and B input signals is deducted, as the min(RGB), from the RGB input signal (step S43).

Next, the min(RGB) is converted to an RGBW signal using an RGBW signal value for representing the target white $W_t$ (255) when R, G, and B input signal values are all 255 (step S44).

Next, by adding, to the deduction value {RGB−min (RGB)} calculated by the above step S43, the RGBW signal calculated by the above step S44, an RGBW signal corresponding to the RGB input signal is calculated (step S45).

First Embodiment

[1] RGB-RGBW Signal Converter

First, an RGB-RGBW signal converter used in a first embodiment of the present invention will be described. The RGB-RGBW signal converter used in the first embodiment uses a processing that is almost the same as the third RGB-RGBW conversion processing described with reference to FIG. 23 to convert an RGB signal to an RGBW signal. However, this processing is different from the third RGB-RGBW conversion processing in that a W usage rate (RGB-RGBW conversion ratio) can be controlled.

Figure 24:
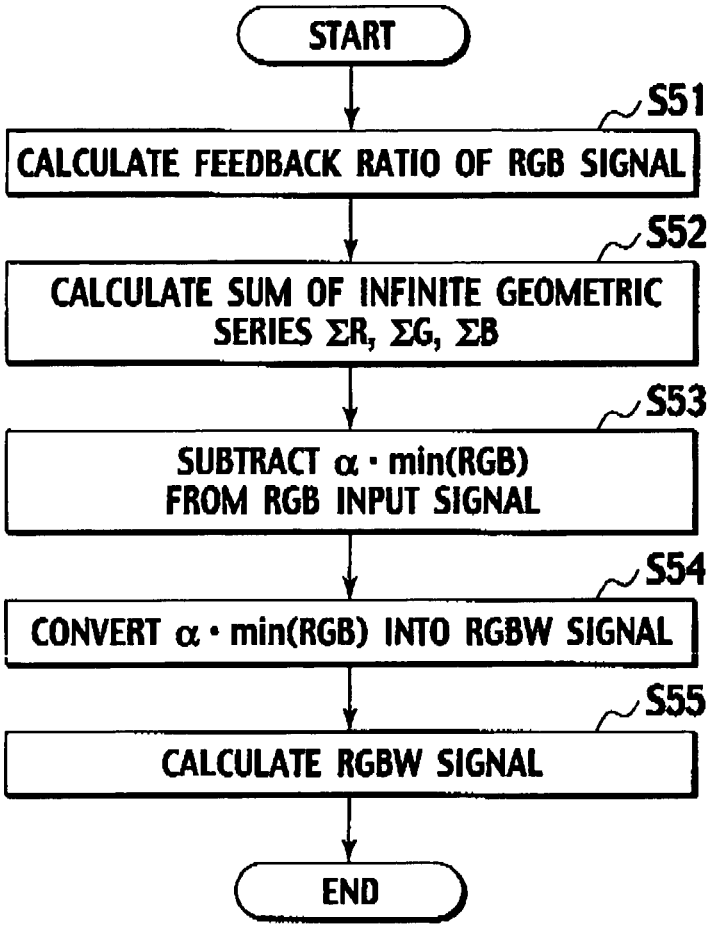
FIG. 24 is a flow chart showing a signal conversion procedure executed by an RGB-RGBW signal converter according to a first embodiment of the present invention.

FIG. 24 shows a procedure of the RGB-RGBW signal conversion processing by the RGB-RGBW signal converter used in the first embodiment.

First, an RGB signal feedback ratio is calculated by an RGBW signal value for representing a target white $W_t$ (255) when R, G, and B input signal values are all 255 (step S51). When assuming that the RGBW signal value for representing the target white $W_t$ (255) has a signal value as shown in FIG. 6, then the RGB signal feedback ratio is 0.3(=77/255), 0, and 0.8(=204/255).

Next, with regards to the respective R, G, and B input signals, the sums of the infinite geometric progressions ΣR, ΣG, and ΣB for which the R, G, and B input signal values are in the first term and the feedback ratio calculated by the above step S51 is used as a common ratio are calculated (step S52).

Next, the minimum value of the sums of infinite geometric progressions ΣR, ΣG, and ΣB calculated for the respective R, G, and B input signals is assumed as the min(RGB) and the set W usage rate is assumed as "α". Then, the α×min(RGB) is deducted from the RGB input signal (step S53).

Next, the α×min(RGB) is converted to an RGBW signal by the RGBW signal value for representing target white $W_t$ (255) when R, G, and B input signal values are all 255 (step S54).

Next, the deduction value {RGB−α×min(RGB)} calculated by step S53 is added with the signal value of the RGBW signal calculated by step S54, thereby calculating the RGBW signal corresponding to the RGB input signal (step S55).

|2| Outline of First Embodiment

Figure 25:
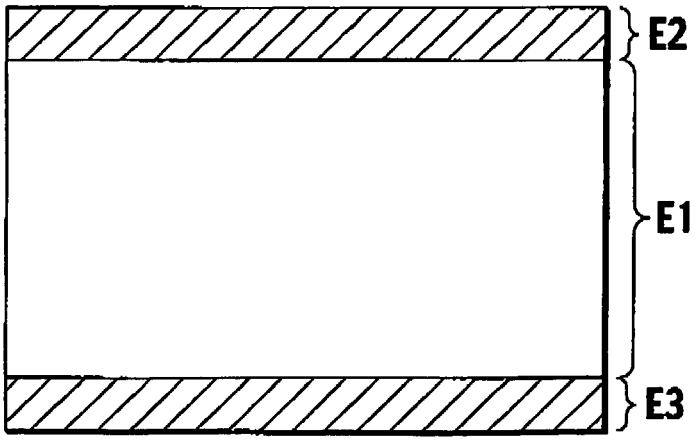
FIG. 25 is a schematic diagram showing a display example when an organic EL display having a solution of 640(II)×480 (V) displays an input signal having an aspect ratio of 16:9.

When an RGBW type organic EL display has a resolution of 640(H)×480(V) and when input video has an aspect ratio of 4:3, the input video is displayed on the entire display area of the organic EL display. However, when the input video has an aspect ratio of 16:9, then the input video is displayed, as shown in FIG. 25, on an area (video display region) E1 between the upper part and the lower part of the display area of the display and thus areas of the upper part and the lower part (no-video display regions) E2 and E3 in which the input video is not displayed always display, for example, gray. In such a case, the no-video display region has a large amount of emission by a W unit pixel among RGB, and W unit pixels, thus causing the W unit pixel to deteriorate easily.

Thus, the first embodiment uses, when the input video has an aspect ratio of 16:9, a W usage rate a of 100[%] in a video display region and uses a W usage rate α lower than 100[%] in a no-video display region. As a result, the no-video display region includes equal deterioration rates of the respective RGB, and W unit pixels. When an input video has an aspect ratio of 4:3, then the entire screen is a video display region and thus a W usage rate α in this case is 100[%].

[3] Arrangement of Display Apparatus

Figure 26:
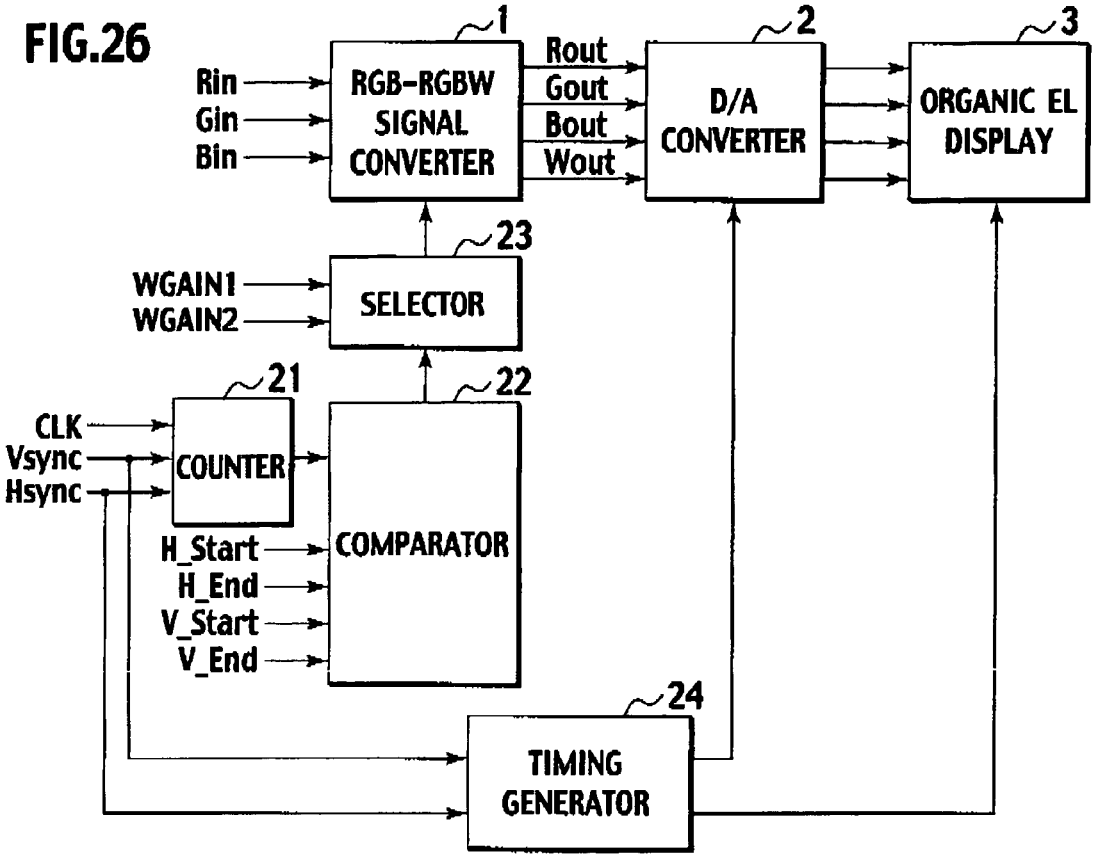
FIG. 26 is a block diagram showing an arrangement of the display apparatus according to the first embodiment.

FIG. 26 shows an arrangement of a display apparatus.

The RGB-RGBW signal converter 1 is inputted with digital R, G, and B signals Rin, Gin, and Bin. The R, G, and B signals Rin, Gin, and Bin include a video signal of video displayed on a video display region and a signal of gray that is displayed on a no-video display region when an input video has an aspect ratio of 16:9. The RGB-RGBW signal converter 1 converts the R, G, and B signals Rin, Gin, and Bin to RGB, and W signals Rout, Gout, Bout, and Wout. The RGB, and W signals Rout, Gout, Bout, and Wout obtained by the RGB-RGBW signal converter 1 are converted, by the D/A converter 2, to analog RGB, and W signals. The RGB, and W signals obtained by the D/A converter 2 are sent to the organic EL display 3 in which one pixel is composed of four RGB, and W unit pixels.

A vertical synchronization signal Vsync and a horizontal synchronization signal Hsync of the R, G, and B signals Rin, Gin, and Bin are sent to a timing generator 24. The timing generator 24 generates a timing signal to send the signal to the D/A converter 2 and the organic EL display 3.

The vertical synchronization signal Vsync, the horizontal synchronization signal Hsync, and a dot signal CLK of the inputted RGB signal are sent to a counter 21. The counter 21 outputs a position signal showing a display position on a screen (horizontal position and vertical position) corresponding to the R, G, and B signals Rin, Gin, and Bin. The position signal outputted from the counter 21 is sent to a comparator 22. The comparator 22 sets signals H_Start, H_End, V_Start, and V_End for defining an area of the video display region.

When input video has an aspect ratio of 4:3, then the area of the video display region is the entire screen Thus, H_Start, H_End, V_Start, and V_End are set to have values showing the area of the entire screen.

When input video has an aspect ratio of 16:9, then the area of the video display region is an area between the upper part and the lower part of the entire screen. Thus, H_Start, H_End, V_Start, and V_End are set to have values as shown below.

H_Start=0

H_End=639

V_Start=60

V_End=419

The comparator 22 compares the position signal of the counter 21 with the set values of H_Start, H_End, V_Start, and V_End to determine whether the display position on the screen is within a video display region or in a no-video display region, thereby outputting the determination signal.

The determination signal outputted from the comparator 22 is sent, as a selector control signal, to a selector (controller) 23. The selector 23 is inputted with a first W usage rate WGAIN1 and a second W usage rate WGAIN2 as the W usage rate α used by the RGB-RGBW signal converter 1. The value of WGAIN1 is set to be 100[%] and the value of WGAIN2 is set to be lower than 100[%].

When the selector 23 is inputted with a determination signal showing that a display position on a screen is within a video display region, then the selector 23 sets WGAIN1 as the W usage rate α to the RGB-RGBW signal converter 1. When the selector 23 is inputted with a determination signal showing that a display position on a screen is within a no-video display region, then the selector 23 sets WGAIN2 as the W usage rate α to the RGB-RGBW signal converter 1.

Thus, when input video has an aspect ratio of 16:9, then W usage rate α of 100[%] is set to the video display region and W usage rate α lower than 100[%] is set to the no-video display region. As a result, the no-video display region also can have equal deterioration rates of the respective RGB, and W unit pixels. This suppresses burn-in.

Second Embodiment

[1] RGB-RGBW Signal Converter

The conversion processing method by the RGB-RGBW signal converter used in a second embodiment is the same as the conversion processing method by the RGB-RGBW signal converter of the first embodiment shown in FIG. 24.

[2] Outline of Second Embodiment

A display apparatus including an RGBW type organic EL display may display an image including an icon. In the display area of the icon (icon display region), a unit pixel among RGB, and W unit pixels that has a large amount of emission tends to deteriorate. When a W usage rate a is 100% as in a conventional case, a W unit pixel in the display area of the icon tends to deteriorate.

In view of the above, the second embodiment uses, when an icon is displayed, a W usage rate α of 100[%] in a display area other than the icon display region (no-icon display region) and uses a W usage rate a lower than 100[%] in the icon display region. As a result, the icon display region has equal deterioration rates of the respective RGB, and W unit pixels.

[3] Arrangement of Display Apparatus

Figure 27:
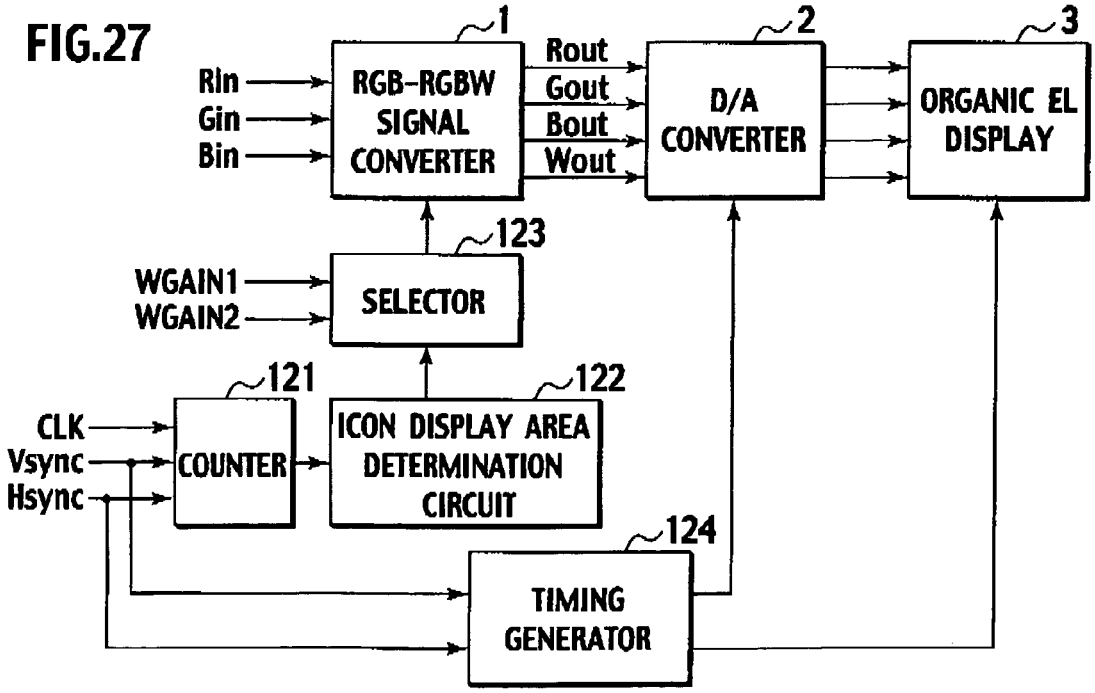
FIG. 27 is a block diagram showing an arrangement of a display apparatus according to a second embodiment of the present invention.

FIG. 27 shows an arrangement of a display apparatus.

The RGB-RGBW signal converter 1 is inputted with digital R, G, and B signals Rin, Gin, and Bin. The R, G, and B signals Rin, Gin, and Bin include a normal video signal and an icon display signal. The RGB-RGBW signal converter 1 converts the R, G, and B signals Rin, Gin, and Bin to RGB, and W signals Rout, Gout, Bout, and Wout. The RGB, and W signals Rout, Gout, Bout, and Wout obtained by the RGB-RGBW signal converter 1 are converted, by the D/A converter 2, to analog RGB, and W signals. The RGB, and W signals obtained by the D/A converter are sent to the organic EL display 3 in which one pixel is composed of four RGB, and W unit pixels.

The vertical synchronization signal Vsync and the horizontal synchronization signal Hsync of the R, G, and B signals Rin, Gin, and Bin are sent to a timing generator 124. The timing generator 124 generates a timing signal to send the signal to the D/A converter 2 and the organic EL display 3.

The vertical synchronization signal Vsync, the horizontal synchronization signal Hsync, and the dot signal CLK of the R, G, and B signals Rin, Gin, and Bin are sent to a counter 121. The counter 121 outputs a position signal showing a display position on a screen corresponding to the R, G, and B signals Rin, Gin, and Bin (horizontal position and vertical position). The position signal outputted from the counter 121 is sent to an icon display area determination circuit 122. The icon display area determination circuit 122 includes a memory. The memory stores an icon display position table that shows icon display positions in the respective different types of display patterns on a screen.

The icon display position table is a table, as shown in FIG. 28 for example, that stores, for the respective display positions, identification data (0 or 1) showing whether an icon is displayed or not. By the data, one is stored for a position at which an icon is displayed and zero is stored for a position at which no icon is displayed.

For a screen in which an icon is displayed, a control signal for selecting an icon display position table corresponding to this screen is sent from a controller (not shown) to an icon display area determination circuit 122.

The icon display area determination circuit 122 selects, based on the control signal from the controller, an icon display position table corresponding to a to-be-displayed screen and determines, based on the position signal of the counter 121 and the selected icon display position table, whether the display position shown by the position signal of the counter 121 is within an icon display region or in a no-icon display region to output the determination signal.

The determination signal outputted from the icon display area determination circuit 122 is sent, as a selector control signal, to a selector (controller) 123. The selector 123 is inputted with, as a W usage rate α used by the RGB-RGBW signal converter 1, the first W usage rate WGAIN1 and the second W usage rate WGAIN2. The WGAIN1 is set to be 100[%] and the WGAIN2 is set to be smaller than 100[%].

When the selector 123 is inputted with a determination signal showing that a display position on a screen is within a no-icon display region, then the selector 123 sets WGAIN1 as the W usage rate α to the RGB-RGBW signal converter 1. When the selector 123 is inputted with a determination signal showing that a display position on a screen is within an icon display region, then the selector 123 sets WGAIN2 as the W usage rate α to the RGB-RGBW signal converter 1.

Thus, when an icon is displayed, W usage rate a is set to be 100[%] for the no-icon display region and W usage rate α is set to be lower than 100[%] for the icon display region. Thus, the icon display region can have equal deterioration rates of the respective RGB, and W unit pixels. This suppresses burn-in.

Third Embodiment

[1] RGB-RGBW Signal Converter

The conversion processing method by the RGB-RGBW signal converter used in a third embodiment of the present invention is the same as the conversion processing method by the RGB-RGBW signal converter of the first embodiment shown in FIG. 24

[2] Outline of Third Embodiment

In the third embodiment, for each pixel, the total light emission amount to the present stage of the respective RGB, and W unit pixels constituting the pixel (accumulation value of signal levels in the respective frames to the present stage) is calculated. Then, when a difference ΔS between the maximum value of the total light emission amount to the present stage of the respective RGB, and W unit pixels and the total light emission amount to the present of the W unit pixel is larger than a threshold value H, then the W usage rate a to this pixel is set to have a value equal to or lower than 100[%]. When ΔS is lower than a threshold value L, then the value of the W usage rate α is returned to 100[%]. This equalizes the deterioration rates of the respective RGB, and W unit pixels of each pixel.

[3] Arrangement of Display Apparatus

Figure 29:
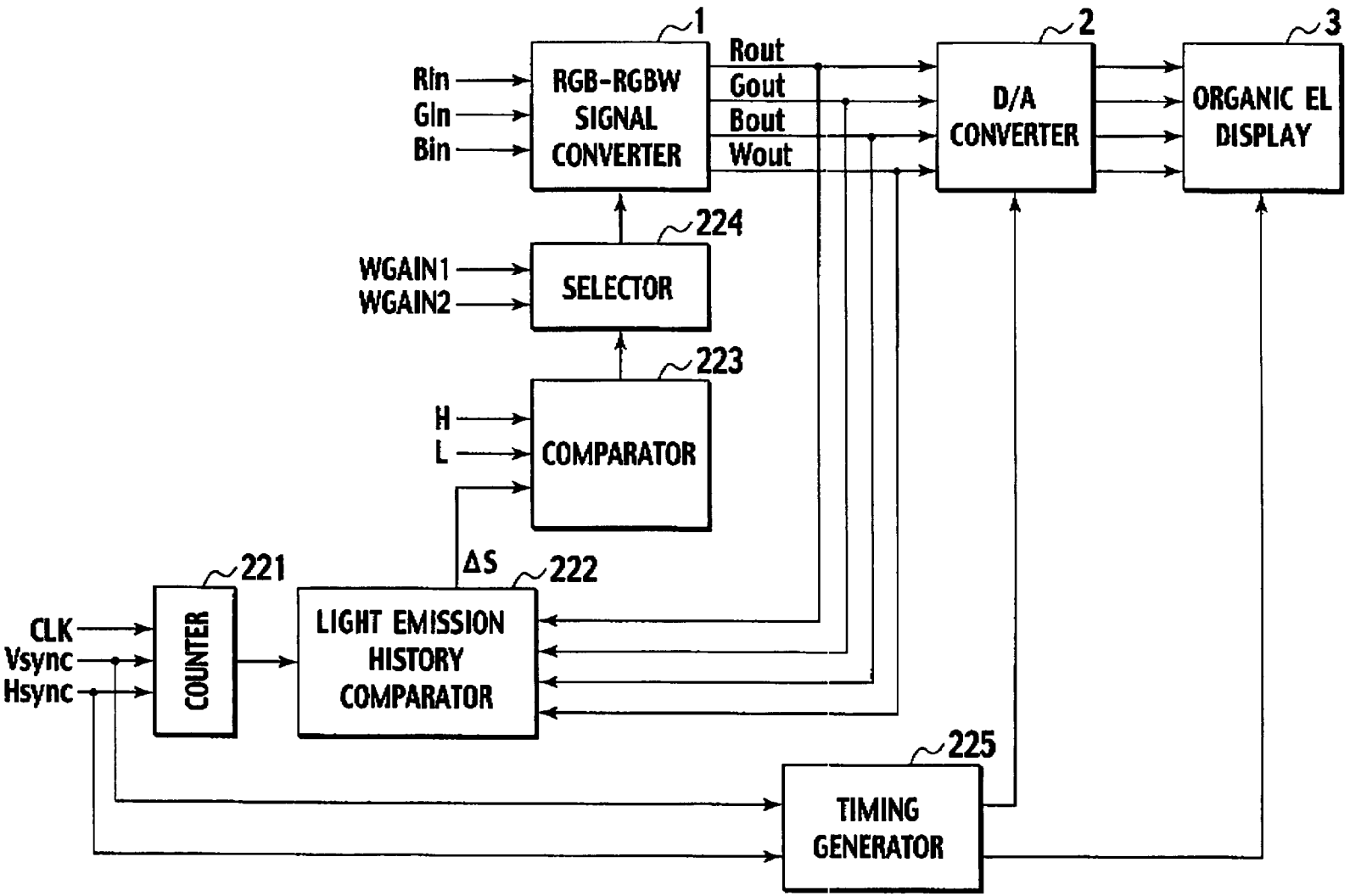
FIG. 29 is a block diagram showing an arrangement of a display apparatus according to a third embodiment of the present invention.

FIG. 29 shows an arrangement of a display apparatus.

The RGB-RGBW signal converter 1 is inputted with digital R, G, and B signals Rin, Gin, and Bin. The R, G, and B signals Rin, Gin, and Bin is converted, by the RGB-RGBW signal converter 1, to RGB, and W signals Rout, Gout, Bout, and Wout. The RGB, and W signals Rout, Gout, Bout, and Wout obtained by the RGB-RGBW signal converter 1 are converted, by the D/A converter 2, to analog RGB, and W signals. The RGB, and W signals obtained by the D/A converter 2 are sent to the organic EL display 3 in which one pixel is composed or four RGB, and W unit pixels.

The vertical synchronization signal Vsync and the horizontal synchronization signal Hsync of the R, G, and B signals Rin, Gin, and Bin are sent to a timing generator 225. The timing generator 225 generates a timing signal to send the signal to the D/A converter 2 and the organic EL display 3.

The vertical synchronization signal Vsync, the horizontal synchronization signal Hsync, and the dot signal CLK of the R, G, and B signals Rin, Gin, and Bin are sent to a counter 221. The counter 221 outputs a position signal showing a display position on a screen corresponding to the R, G, and B signals Rin, Gin, and Bin (horizontal position and vertical position). The position signal outputted from the counter 221 is sent to a light emission history comparator 222.

The light emission history comparator 222 calculates, based on the RGB, and W signals Rout, Gout, Bout, and Wout outputted from the RGB-RGBW signal converter 1, the total light emission amount to the present stage of the respective RGB, and W unit pixels constituting each pixel to store the amount in a memory. The light emission history comparator 222 calculates, based on the position signal outputted from the counter 221 and the contents of the memory, the maximum value A of the total light emission amount to the present stage of the respective R, G, and B unit pixels corresponding to a pixel represented by the position signal outputted from the counter 221 and the total light emission amount B to the present stage of the W unit pixel corresponding to this pixel to calculate the difference ΔS(=B−A).

The ΔS calculated by the light emission history comparator 222 is sent to the comparator 223. The comparator 223 has therein the threshold value L and the threshold value H(L<H). When ΔS<L is established, the comparator 223 outputs the first determination signal. When ΔS>H is established, the comparator 223 outputs the second determination signal When L≦Δ≦H is established, then the previously-outputted determination signal is outputted to the pixel.

The determination signal outputted from the comparator 223 is sent, as a selector control signal, to the selector (controller) 224. The selector 224 is inputted with the first W usage rate WGAIN1 and the second W usage rate WGAIN2 as the W usage rate α used by the RGB-RGBW signal converter 1. The value of WGAIN1 is set to be 100[%] and the value of WGAIN2 is set to be lower than 100[%].

When the selector 224 is inputted with the first determination signal, then WGAIN1 is set as the W usage rate α to the RGB-RGBW signal converter 1. When the selector 224 is inputted with the second determination signal, then WGAIN2 is set as the W usage rate a to the RGB-RGBW signal converter 1.

Figure 30A:
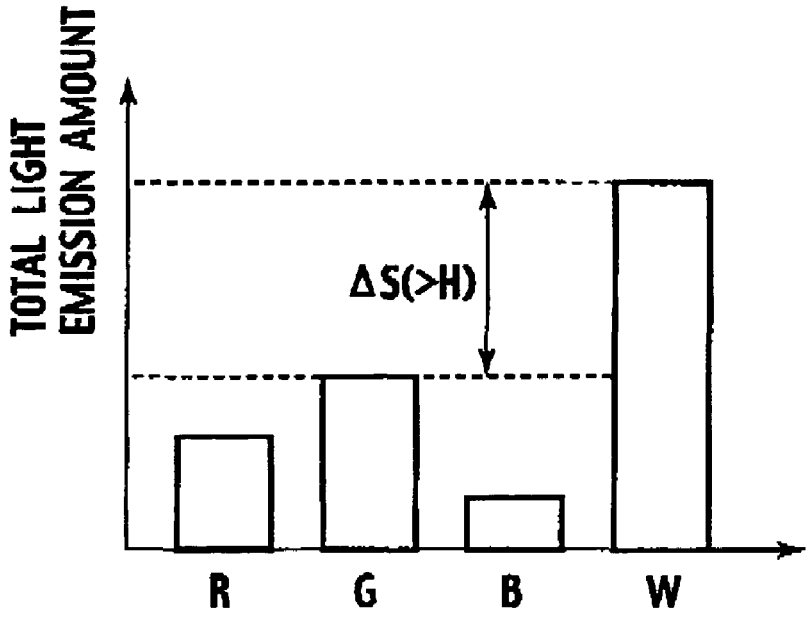
FIG. 30A is a graph showing a case where ΔS is higher than H.
Figure 30B:
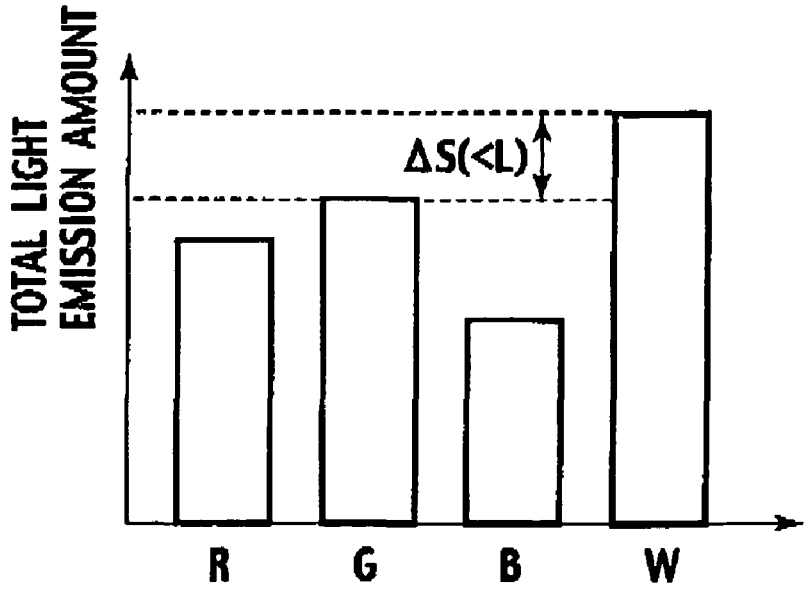
FIG. 30B is a graph showing a case where ΔS is lower than H.

Thus, when ΔS is higher than H in each pixel as shown in FIG. 30A, then the W usage rate α is set to have a value lower 100[%]. When ΔS is lower than L as shown in FIG. 30B, then the W usage rate α is set to have a value of 100[%]. This can equalize deterioration rates of the respective RGB, and W unit pixels constituting each pixel. This suppresses burn-in.

Other Embodiments

Various modifications will become possible for those skilled in the art after receiving the teachings of the present disclosure without departing from the scope thereof.

Although the above section has described, in the respective exemplary embodiments, the display apparatus including an RGBW-type self light-emitting display, this invention also can be applied to a display apparatus including an RGBX-type self light-emitting display (X is an arbitrary color other than R, G, and B).

What is claimed is:

1. A display apparatus comprising:

a RGB-RGBX signal converter having a variable RGB-RGBX conversion ratio and configured to convert a RGB signal into a an RGBX signal, X refers to an arbitrary color other than R, G, and B;

a RGBX type self light-emitting display configured to display video, based on the RGBX signal obtained by the RGB-RGBX signal converter, including:

a video display region which is an area between upper and lower parts of the self light-emitting display, and configured to display an input video;

a no-video display regions which are areas of the upper and lower parts of the self light-emitting display, and configured to display gray bands when an aspect ratio of the input video is different from an aspect ratio of the self light-emitting display, a determination circuit configured to determine whether a display position of the RGB signal is in the video display region or in the no-video display regions; and a controller configured to control the RGB-RGBX conversion ratio utilized for converting the RGB signal into the RGBX signal, in accordance with a determination result of the determination circuit, wherein the controller sets a different value to the RGB-RGBX conversion ratios of a case where the display position is in the video display region and a case where the display position is in the no-video display regions.

2. A display apparatus comprising:

a RGB-RGBX signal converter having a variable RGB-RGBX conversion ratio and configured to convert a RGB signal into a an RGBX signal, X refers to an arbitrary color other than R, G, and B;

a RGBX type self light-emitting display configured to display video, based on the RGBX signal obtained by the RGB-RGBX signal converter, a determination circuit configured to determine whether a display position of the RGB signal is in an icon display region displaying an icon or in no-icon display region not displaying the icon; and a controller configured to control the RGB-RGBX conversion ratio utilized for converting the RGB signal into the RGBX signal, in accordance with a determination result of the determination circuit, wherein the controller sets a different value to the RGB-RGBX conversion ratios of a case where the display position is in the icon display region and a case where the display position is in the no-icon display regions.

3. A display apparatus comprising:

a signal converter configured for converting a RGB signal into a RGBX signal, wherein X is a color other than R, G, and B;

a RGBX type display configured to display video, based on the RGBX signal obtained from the signal converter, the RGBX type display including:

a video display region comprising an area between upper and lower parts of the display, and configured to display an input video;

a non-video display region comprising an area of the upper and/or lower parts of the display, the non-video display region displaying gray bands when an aspect ratio of the input video is different from an aspect ratio of the display, and a controller controlling a conversion ratio utilized for converting the RGB signal into the RGBX signal, wherein the controller sets a different value of the conversion ratio when the display position is in the video display region relative to when the display position is in the non-video display region.

4. A display apparatus comprising:

a signal converter configured to convert a RGB signal into a RGBX signal, wherein X refers is a color other than R, G, and B;

a RGBX type display configured to display video, based on the RGBX signal obtained by the signal converter, and a controller controlling a conversion ratio utilized for converting the RGB signal into the RGBX signal, wherein in accordance with a determination result of a determination circuit, the controller sets a value to a RGB-RGBX conversion ratio when the display position is in an icon display region which value is different from a value set when the display position is in a no-icon display region.

* * * * *